United States Patent [19]

Olsen

[11] Patent Number: 4,564,750

[45] Date of Patent: Jan. 14, 1986

[54] DEVICE FOR COMBINATION OF DATA

[76] Inventor: Pal B. Olsen, Walter Roffs vei 4, N-4300 Sandnes, Norway

[21] Appl. No.: 625,313

[22] Filed: Jun. 28, 1984

[30] Foreign Application Priority Data

Jul. 7, 1983 [NO] Norway ..... 832476

[51] Int. Cl.[4] ..... G06C 3/00

[52] U.S. Cl. ..... 235/89 R

[58] Field of Search ..... 235/61 NV, 89 R, 88 N, 235/78 N, 61 V, 70 R, 69

[56] References Cited

U.S. PATENT DOCUMENTS

| | | | |
|---|---|---|---|
| 1,087,445 | 2/1914 | Herrick | 235/89 R |
| 2,512,446 | 6/1950 | Spielmann | 235/89 R |
| 3,005,586 | 10/1961 | Stevenson | 235/89 R |
| 3,540,648 | 11/1970 | McGee | 235/89 R |
| 3,656,688 | 4/1972 | Camp | 235/61 NV X |
| 3,747,847 | 7/1973 | Cohen | 235/89 R |
| 4,346,288 | 8/1982 | Foster | 235/88 N X |
| 4,454,410 | 6/1984 | Merl | 235/89 R |

FOREIGN PATENT DOCUMENTS 2632799 1/1978 Fed. Rep. of Germany .

*Primary Examiner*—Benjamin R. Fuller
*Attorney, Agent, or Firm*—James & Franklin

[57] ABSTRACT

A device for combining data comprises a frame and at least an upper and a lower plate which plates are freely displaceable in parallel planes in mutually perpendicular directions in the frame. The frame is provided with a first and a second window for positioning of each of the plates in relation to the frame in dependence on given initial data, and the lower plate is provided with data which can be displayed through associated windows in the upper plate in dependence on the position of the plates in relation to each other.

4 Claims, 1 Drawing Figure

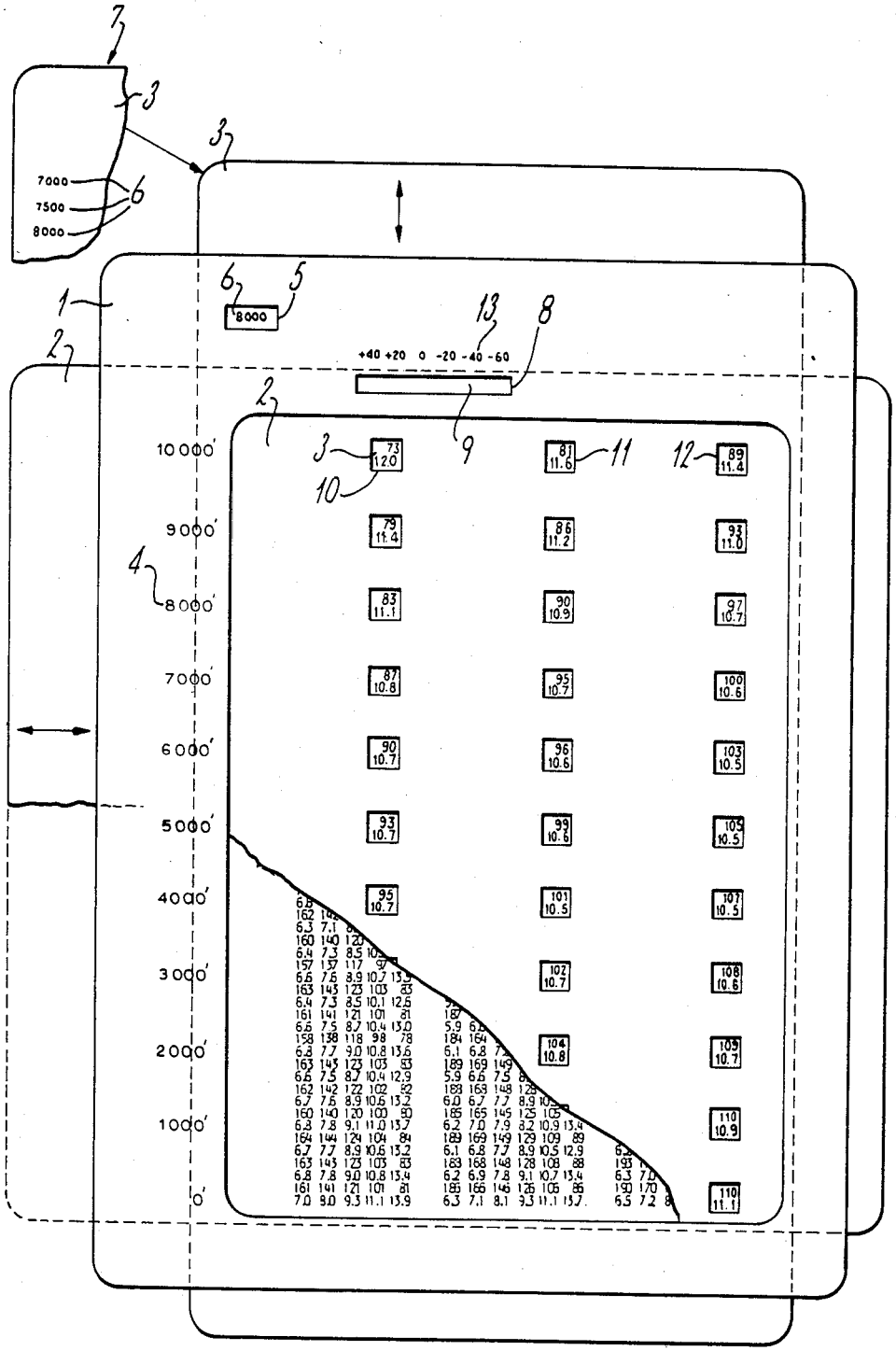
7000
7500
8000
8000
+40 +20 0 -20 -40 -60
10000'
9000'
8000'
7000'
6000'
5000'
4000'
3000'
2000'
1000'
0'

DEVICE FOR COMBINATION OF DATA

The present invention relates to a device for combining data, comprising a frame and at least an upper and a lower plate which are displaceably arranged in said frame and further are displaceable in relation to each other, at least one of said plates being provided with a series of data capable of being displayed in associated display fields dependent on the position of the plates relative to each other and to said frame.

Such a device is known from German patent specification No. 2,632,799. In the known device it is the question of an apparatus for displaying data, more specifically an echo-sounder recorder which is switchable to different depth measuring ranges. The apparatus comprises a frame covering a pair of interconnected and displaceable plates, one of the plates having data applied thereto and the frame having windows for exposing data belonging together.

A computer apparatus for combining data during flight with a motor-driven aircraft is known from U.S. Pat. No. 3,656,688. This apparatus comprises a housing wherein there are arranged a vertically movable tape and a horizontally movable tape, the housing and the tapes being provided with data which can be combined. By means of the apparatus one is able to instantly compute estimated arrival time, distance and fuel content at any time along the airway route. However, the apparatus can not indicate data for e.g. optimum utilization of the fuel when flying under different conditions.

In order to achieve optimum fuel utilization during flying, it will be necessary to choose the most favourable flying altitude, and also to vary the engine power in dependence on the wind conditions prevailing at any time. In the tables presently used to indicate optimum fuel utilization, the wind conditions are not taken into account. Since it is very complicated during flying to estimate or compute the influence of varying wind conditions on the engine power and flying altitude which should be used, such computations are seldom performed, or one performs only a rough estimate.

The omission of carrying out such computations, and the use of a rough estimate, results in non-optimum fuel utilization. Since it is, as mentioned, complicated computations which possibly have to be performed, also the possibility of miscalculation is great.

The object of the present invention is to provide a device for combining data which is constructed in such a manner that it affords a great flexibility both with respect to chosen parameters—i.e. field of utilization—and with respect to the data which can be combined and displayed, and which also has a great capacity with respect to the amount or number of data.

Another object is to provide such a device which is particularly suitable for use during flying, and which eliminates the above-mentioned drawbacks.

A further object of the invention is to provide a device which enables simple and economic manufacture thereof.

According to the invention there is provided a device of the type set forth above, wherein said plates are freely displaceable in parallel planes in mutually crossing directions in said frame, the frame being provided with a firt and a second window for positioning each of said plates in relation to said frame in dependence on given initial data, and wherein said lower plate is provided with data which can be displayed through associated windows in said upper plate.

The invention will be further described below in connection with an exemplary emboidment with reference to the accompanying drawing the only FIGURE of which shows a device according to the invention viewed from above and with parts of the device cut away to facilitate the survey.

In the following the device according to the invention will be described in connection with the use on a motor-driven aircraft, but it will be appreciated that the device can also be adapted for other fields of utilization.

The device illustrated in the FIGURE comprises a frame 1 in which there are arranged an upper plate 2 and a lower plate 3 which are arranged to be freely displaced in relation to each other in the frame in mutually perpendicular directions. In the FIGURE, the plate 2 is horizontally displaceable whereas the plate 3 is vertically displaceable.

Along one vertical side of the frame 1 there are set out different flying altitudes 4. At the upper part of the frame there is provided a window 5 wherein different data 6 on the plate 3, in the illustrated case the weight of the aircraft, will appear dependent on the position of the plate in the frame, cf. the cut 7 of the plate 3. In the frame 1 there is also provided a larger window 8 arranged to indicate the position of the plate 2 in relation to the frame 1, which position is indicated by means of a marker 9 on the plate 2, in dependence on the wind velocity 13.

On the lower plate 3 all the performance or power information is entered, and the upper plate 2 is provided with windows arranged in rows and columns for exposing performance information on the underlying plate 3. In the illustrated embodiment, three windows 10, 11, 12 are disposed horizontally in the plate 2 on a level with each flying altitude 4 on the frame 1. In window 10 there are indicated for example data at 65% engine power, in window 11 data at 70% engine power are indicated and in window 12 data at 75% engine power are indicated.

As one will understand, the frame 1 is transparent or has a cut-out portion in the region of the windows of the plate 2, but is opaque in the edge regions apart from the windows 5 and 8.

In the use of the device according to the invention, the plate 3 is positioned such that the weight 6 of the aircraft appears in the window 5. The plate 3 is thereby positioned in relation to the frame 1. Thereafter the plate 2 is positioned such that the marker 9 corresponds to the actual wind velocity 13 indicated on the frame 1. The plate 2 is thereby positioned in relation to the frame 1 and the plate 3, and by comparing the different data appearing in the windows 10, 11 and 12, the user may very quickly be able to ascertain which flying altitude and engine power will give the optimum range. In the illustrated example, the data appearing in each of the windows 10, 11 and 12, are the aircraft velocity at the top and fuel consumption per distance unit at the bottom.

In order to simplify the reading and be able to directly extract desired information, the different data on the plate 3 may be surrounded by various colours in accordance with a chosen colour code, so that the performance data which ought to be used, appear in one colour, e.g. green, whereas unfavourable performance data appear in other colours dependent on how little favourable the altitudes and engine powers are. If the aircraft (e.g. an airplane or a helicopter) has a weight 6 other than that appearing on the plate 3, and/or the wind velocity 13 is another than that appearing on the frame 1, it is possible to position the plates 2 and 3 on intermediate values of wind velocity and weight, respectively. As a result of the special colour coding of the performance data, one will also then be able to read directly the most favourable flying altitude and engine power.

It will be appreciated that a device according to the invention will be able to be used for combining a variety of other data than those described above. By combining other data or other information, the device will for example be able to be used to give the pilot information about maximum range, optimum economic flying, optimum climbing, optimum descent together with data in connection with takeoff from the runway. The device according to the invention will also be able to be adapted for the combination of data e.g. relating to shipping and economy, and the device will thus be able to have a very multifarious field of utilization.

I claim:

1. A device for combining data, comprising a frame and at least an upper and a lower plate displaceably arranged in said frame, said plates being located in superimposed parallel planes and being freely displaceable in mutually perpendicular directions, said lower plate being provided with a plurality of data arrranged in rows and columns respectively parallel to and normal to the displacement direction of said plate, said upper plate being provided with a plurality of windows arranged in similar rows and columns, for displaying data on the lower plate in dependence on the relative position of the plates, said frame being provided with a first and a second window for positioning each of said plates in relation to said frame in dependence on given initial data.

2. A device according to claim 1, wherein said data of the lower plate are indicated by means of varying colors in accordance with a chosen color code.

3. A device according to either of claims 1 or 2, for use on board a motor-driven aircraft, wherein said given initial data which determine the position of said plates in relation to said frame are the actual wind conditions and the weight of said aircraft, respectively, and said lower plate indicates flight optimizing data capable of being read through said windows of the upper plate as a function of chosen parameters, such as flight altitude and power setting.

4. A device according to either claims 1 or 2, wherein said lower plate is reversible in said frame, said plate on its two sides being provided with data belonging to different programs.

* * * * *